US006887806B2

(12) United States Patent
Vanassche et al.

(10) Patent No.: US 6,887,806 B2
(45) Date of Patent: May 3, 2005

(54) CUT RESISTANT FABRIC FOR PROTECTIVE TEXTILES

(75) Inventors: Roger Vanassche, Zwevegem (BE); Luc Leman, Aalbeke (BE); Marc Vanhoucke, Harelbeke (BE); Lode Puype, Waregem (BE)

(73) Assignee: N.V. Bekaert S.A., Zwevegem (BE)

( * ) Notice: Subject to any disclaimer, the term of this patent is extended or adjusted under 35 U.S.C. 154(b) by 174 days.

(21) Appl. No.: 10/275,765

(22) PCT Filed: Apr. 20, 2001

(86) PCT No.: PCT/EP01/04499

§ 371 (c)(1),
(2), (4) Date: Nov. 8, 2002

(87) PCT Pub. No.: WO01/86046

PCT Pub. Date: Nov. 15, 2001

(65) Prior Publication Data

US 2003/0176129 A1 Sep. 18, 2003

(51) Int. Cl.[7] ..... B32B 27/12

(52) U.S. Cl. ..... 442/134; 442/4; 442/5; 442/6; 442/38; 442/40; 442/52; 428/920; 428/921; 2/2.5

(58) Field of Search ..... 2/2.5; 428/920, 428/921; 89/36.01, 36.02, 36.05; 442/4, 5, 6, 38, 40, 52, 134, 135

(56) References Cited

U.S. PATENT DOCUMENTS

| | | | | | |
|---|---|---|---|---|---|
| 2,269,869 | A | | 1/1942 | Specht | |
| 4,408,444 | A | | 10/1983 | Baillievier | |
| 5,224,363 | A | * | 7/1993 | Sutton | 66/202 |
| 5,883,018 | A | * | 3/1999 | Bourgois et al. | 442/134 |

FOREIGN PATENT DOCUMENTS

| | | |
|---|---|---|
| EP | 0 790 349 B1 | 8/1997 |
| GB | 546 508 | 7/1942 |
| GB | 2 078 802 | 1/1982 |
| GB | 2 324 100 | 10/1998 |
| WO | WO 97/27769 A2 | 8/1997 |
| WO | WO 98/55682 A1 | 12/1998 |
| WO | WO 99/20682 A1 | 4/1999 |
| WO | WO 99/28547 A1 | 6/1999 |
| WO | WO 99/55793 A1 | 11/1999 |

* cited by examiner

*Primary Examiner*—Ula Ruddock
(74) *Attorney, Agent, or Firm*—Foley & Lardner LLP

(57) ABSTRACT

A fabric comprising elongated steel elements is provided. This fabric is to be used to provide cut-resistance or reinforcement for protective textiles. Elongated steel elements are in contact relationship, so improving the resistance to knife cutting actions.

24 Claims, 3 Drawing Sheets

CUT RESISTANT FABRIC FOR PROTECTIVE TEXTILES

FIELD OF THE INVENTION

The present invention relates to a fabric, e.g. to be used to provide reinforcement or cut-resistance to protective textiles, such as e.g. clothing, canvasses, tents and shelters.

The present invention relates more in particular to such fabrics, being woven and comprising steel cords in warp and/or weft direction. The present invention further relates to the use of such a fabric to provide cut-resistance to protective textiles such as e.g. clothing, canvasses, tents or shelters. It further relates to canvasses and clothing, comprising such fabric.

BACKGROUND OF THE INVENTION

Fabrics with steel cords are widely known, as stab-resistant inserts comprising steel cords from WO9727769.

Further, canvas reinforcements comprising metal elements are also known from WO9855682. This document teaches that several metal elements, separated from each other and being embedded in a polymer strip, may be adhered to the inner side of canvasses to provide reinforcement.

SUMMARY OF THE INVENTION

It is an object of the invention to improve the resistance against the cutting action of a knife or cutter of protective textile, which comprises a fabric as subject of the invention comprising elongated steel elements.

According to the present invention, a fabric comprises a warp and a weft. The warp comprises different warp elements, laying in a same direction, the so-called warp direction. The weft comprises different weft elements, laying in a same direction, the so-called weft direction. Each warp and weft element follows a certain path through the fabric, being respectively a warp path or a weft path. According to the invention, at least one warp element or one weft element, or both, comprise two or more elongated steel elements, which are in contact relationship with each other.

Warp element is to be understood as one or more individual elements such as e.g. yarns, filaments, bundles of fibers, wires or cords, which follow the same path through the fabric in warp direction. Preferably, but not necessarily, all individual elements of a warp element cross the weft elements of the fabric in an identical way. Weft element is to be understood as one or more individual elements such as e.g. yarns, filaments, bundles of fibers, wires or cords, which follow the same path through the fabric in weft direction. Preferably, but not necessarily, all individual elements of a weft element cross the warp elements of the fabric in an identical way.

"In contact relationship" is to be understood as two or more individual elements contacting each other almost continuously over their length, along a so-called contact zone. From time to time, the contact may be slightly interrupted, due to small undulations or unevenness over their surface. The contact between the different individual elements of a warp element, respectively weft element may also be interrupted in case these different individual elements cross the individual elements of a weft element respectively warp element, in a non-identical way.

The applicant has found that the resistance of a protective textile comprising a fabric as subject of the invention with elongated steel elements is improved drastically in a cutting direction, not parallel to the elongated steel element, when more than one elongated steel elements are woven in the fabric in contact relationship with each other. When elongated steel elements are present in the warp direction of the fabric, two or more elongated steel elements may be in contact relationship with each other in warp direction. They act, so to say, as twin or multiple elongated steel elements. When the elongated steel elements are present in weft direction, two or more elongated steel elements may be in contact relationship with each other in weft direction.

It was even found that the cut-resistance is improved when two or more elongated steel elements are in contact relationship with each other, compared to a same number of elongated steel elements, each running individually through the fabric, not being in contact relationship with adjacent elongated steel elements. So the cut-resistance can be improved, without adding additional elongated steel elements to the fabric. According to the present invention, the elongated steel elements in contact relationship may be identical or may differ from each other, e.g. comprising different wire diameters, having different cord constructions, being provided out of different steel alloys, or having different mechanical properties.

Since the fabric as subject of the invention is used to provide cut-resistance and reinforcement to protective textiles, distances between adjacent warp and weft elements preferably are relatively large. If these distances are too small, the protective textile will loose to a large extend its textile characteristic, meanwhile the weight of the fabric will render the protective textile too heavy to be used. Therefor, a fabric comprising metal elements which is used to provide cut resistance to protective textiles, have a "steel covering ratio Cs", which is relatively low. Steel covering ratios of fabrics as subject of the invention may be less than 75%, preferably less than 60%, such as less than 40%, or even less than 30%.

This steel covering ratio Cs is the percentage of the fabric's surface in flat position, which is provided by the elongated steel elements in warp and/or weft direction.

When only one type of elongated steel element is present in warp direction, and/or only one type of elongated steel element is present in weft direction, this steel covering ratio Cs is to be calculated using the formula:

$$Cs=(B*\alpha*Da+A*\beta*Db-\alpha*\beta*Da*Db)*100/A*B$$

Wherein

A=length of the fabric in warp direction

B=length of the fabric in weft direction $\alpha$=Number of elongated steel elements present in A $\beta$=Number of elongated steel elements present in B Da=diameter of elongated steel element in warp direction A Db=diameter of elongated steel element in weft direction B When n different types of elongated steel elements are present in warp direction and/or m different types of elongated steel elements are present in weft direction, the formula reads as:

$$Cs=[B*(\Sigma_n\alpha_n*Da_n)+A*(\Sigma_m\beta_m*Db_m)-(\Sigma_n\alpha_n*Da_n)*(\Sigma_m\beta_m*Db_m)]*100/A*B$$

Wherein $$\Sigma_n\alpha_n*Da_n=\alpha_1*Da_1+\alpha_2*Da_2+\ldots+\alpha_n*Da_n$$

$$\Sigma_m\beta_m*Db_m=\beta_1*Db_1+\beta_2*Db_2+\ldots+\beta_m*Db_m$$

With "different types of elongated steel elements" is meant that the elongated steel elements differ from each other, e.g. comprising different wire diameters, having different cord constructions, being provided out of different steel alloys, of having different mechanical properties.

Elongated steel elements may be present in only the warp elements or weft elements. It should be clear that, according to the invention, elongated steel elements present only in warp elements, only in weft elements or in both are to be present as more than one elongated steel element, being in contact relationship with each other.

In case both in warp direction and weft direction elongated steel elements are in contact relationship with each other as subject of the invention, it is not necessary that warp elements and weft elements have to comprise the same number of elongated steel elements. Warp elements and weft elements may comprise a different number of elongated steel elements. Also different warp elements and/or different weft elements may comprise a different number of elongated steel elements.

One understands that, according to the invention, different weaving structures may be used. Also different distances between adjacent warp elements and weft elements may be used. Also different elongated steel elements may be used in warp and weft direction. It is even so that different elongated steel elements may be used to provide the elongated steel elements, which run either in warp elements or weft elements in contact relationship with each other.

Different elongated steel elements may be used to provide a fabric as subject of the invention.

An elongated steel element to be used in either the weft or the warp, or in both, can take following forms:

(a) a single steel wire;

(b) a bundle of non-twisted steel wires;

(c) a steel cord, i.e. a twisted structure with two or more steel wires.

These elongated steel elements all have following common features:

- the wire diameter ranges from 0.03 mm to 0.60 mm, preferably from 0.04 mm to 0.45 mm;
- the steel composition is preferably a plain carbon steel composition, i.e. it generally comprises a minimum carbon content of 0.40% (e.g. at least 0.60% or at least 0.80%, with a maximum of 1.1%), a manganese content ranging from 0.10 to 0.90% and a silicon content ranging from 0.10 to 0.90%; the sulphur and phosphorus contents are each preferably kept below 0.03%; additional micro-alloying elements such as chromium (up to 0.2 à 0.4%), boron, cobalt, nickel, vanadium . . . may be added to the composition; stainless steel compositions are, however, not excluded;
- the carbon steel wires are preferably covered with a corrosion resistant coating such as zinc or such as a zinc alloy, e.g. an aluminum-zinc alloy: the aluminum content may range from 2 to 12% in the metallic fraction of the zinc alloy coating, e.g. from 4 to 6.5%, and is preferably about the eutectic value of 5%; a wetting agent is preferably present in an amount sufficient to have wetting of the substrate steel by the zinc-aluminum alloy; amounts smaller than 0.1% are usually sufficient for the wetting agent. The wetting agent can be cerium in an amount ranging from 0.01% to 0.05% and/or lanthanum in an amount ranging from 0.01% and 0.06%. All mentioned percentages are here percentages by weight of the zinc alloy coating.

Organic coatings may be used to improve the adhesion from the elongated steel elements with polymer matrix material such as disclosed in WO-A1-99/20682 and WO-A1-99/55793.

If the elongated steel element is a steel cord, various existing steel cord constructions may be used.

Examples here are:

- multi-strand steel cords e.g. of the m×n type, i.e. steel cords, comprising m strands with each n wires, such as 4×7×0.10 or 3×3×0.18; the last number is the diameter of each wire, expressed in mm.
- compact cords, e.g. of the 1×n type, i.e. steel cords comprising n steel wires, n being greater than 8, twisted in only one direction with one single step to a compact cross-section, such as 1×9×0.18 or 1×12×0.18; the last number is the diameter of each wire, expressed in mm. If these compact cords have a high twisting pitch, i.e. a lay length greater than hundred times the wire diameter, the cords can take a flat cross-section at the cross points between warp and weft, which decreases the thickness of the fabric. A person skilled in the art understands that this effect of decreasing is not limited to a specific number of steel cords either in warp or weft elements, or both. This effect is also apparent when warp and/or weft comprises only one steel cord per warp and/or weft element.
- layered steel cords e.g. of the l+m (+n) type, i.e. steel cords with a core of l wires, surrounded by a layer of m wires, and possibly also surrounded by another layer of n wires, such as 2+4×0.18; the last number is the diameter of each wire, expressed in mm.
- single strand steel cords e.g. of the 1×m type, i.e. steel cords comprising m steel wires, m ranging from two to six, twisted in one single step, such as 1×4×0.25; the last number is the diameter of each wire, expressed in mm.
- Open steel cords e.g. of the m+n type, i.e. steel cords with m parallel steel wires surrounded by n steel wires, such as disclosed in U.S. Pat. No. 4,408,444, e.g. a steel cord 2+2×0.25; the last number is the diameter of each wire, expressed in mm.

The steel cord used in the context of the present invention may be a steel cord with a high elongation at fracture, i.e. an elongation exceeding 4%, e.g. an elongation between 5% and 10%. High elongation steel cord has more capacity to absorb energy.

Such a steel cord is:

- either a high-elongation or elongation steel cord, i.e. a multi-strand or single strand steel cord with a high degree of twisting (in case of multi-strand steel cords: the direction of twisting in the strand is equal to the direction of twisting of the strands in the cord: SS or ZZ, this is the so-called Lang's Lay) in order to obtain an elastic cord with the required degree of springy potential; an example is a 3×7×0.22 High Elongation steel cord with lay lengths 4.5 mm and 8 mm in SS direction;
- or a steel cord which has been subjected to a stress-relieving treatment such as disclosed in EP-A1-0 790 349; an example is a 2×0.33+6×0.33 SS cord.

As an alternative or in addition to a high elongation steel cord, the steel cord may be composed of one or more wires which have been plastically deformed so that they are wavy. This wavy nature additionally increases the elongation. An example of a wavy pattern is a helix or a spatial crimp such as disclosed in WO-A1-99/28547.

In order to calculate the steel covering ratio when steel cords are used to provide a fabric as subject of the invention, the diameter of the steel cord is defined as the diameter of the smallest imaginary circle, which circumscribe a radial section of the steel cord.

Next to elongated steel elements, synthetic or natural fiber yarns may be used to provide a fabric as subject of the invention, providing other protective characteristics to the fabric such as flame retardant properties and bullet-proof properties. Or such yarns may be used to fill the fabric structure by closing the openings between warp and weft elements comprising elongated steel elements. Fibers such as polyaramid fibers, glass fibers, cotton or wool fibers, fibers from polypropylene, polyethylene, polyester, polybezobisoxazole, poly(p-phenylene-2,6-benzobisoxazole), polybenzimidazole or polyacryl may be used.

Fabrics as subject of the invention are to be used to reinforce or to provide cut-resistance to protective textiles. Protective textiles are to be understood in the largest way. Textiles protecting human or animal bodies against cutting actions, e.g. protective vests are to be understood. A fabric as subject of the invention may be used as one of the textile fabrics, who are added one on top of the other, so providing the protective functioning.

Also textile fabrics to be used as a base for seat coverings are to be understood.

Further, protective textiles may be used to provide e.g. canvasses, tents, shelters (e.g. for sheltering a passage between two train wagons), building textiles, dock-shelters, windable or foldable curtains or tops of convertibles.

One or more textile layers, of which one is to be a fabric as subject of the invention may be added on top of the other and laminated to each other.

Possibly, a polymer layer may be provided on one or both sides of the fabrics, in such a way that the polymer layer or layers adhere to the fabric, e.g. by calandering, laminating or extrusion. A protective textile is provided in this way. Also protective canvasses, to be used e.g. on trucks, containers or trains are to be understood as protective textiles. A fabric as subject of the invention is inserted between two or more layers of polymer and e.g. calandered or laminated between them, or a fabric as subject of the invention may be coated on one or both sides with a polymer layer, e.g. by extrusion.

When polymer layers are provided on both sides of the fabric as subject of the invention, best result as far as improvement of cut-resistance were obtained when the adherence of the polymer with the steel of the elongated steel element is reduced to a minimum at the contacting zone of two or more elongated steel elements being in contact relationship with each other.

Canvasses for different uses may be provided using a fabric as subject of the invention. E.g. canvasses for trucks comprising a fabric as subject of the invention may be of the curtain type or of the roll-up type. Canvasses of the curtain type are slidingly suspended on horizontal rails and can be horizontally slid to one side to open the canvas. Canvasses to the curtain type require flexibility in the horizontal direction. Canvasses of the roll-up type can be rolled up vertically to open the canvas. Canvasses of the roll-up type require flexibility vertically. Different elongated steel elements may be used to provide a fabric as subject of the invention, still providing the necessary flexibility in horizontal or vertical direction, however providing sufficient cut-resistance or reinforcement in both horizontal and vertical direction.

Different polymers may be used to provide protective textiles such canvasses, e.g. silicon-based polymers, polyurethane, polyamide, polyvinylchloride, synthetic or natural rubbers, polyesters or polytetrafluorethylene.

BRIEF DESCRIPTION OF THE DRAWINGS

The invention will now be described into more detail with reference to the accompanying drawings wherein.

DESCRIPTION OF THE PREFERRED EMBODIMENTS OF THE INVENTION

Figure 1:
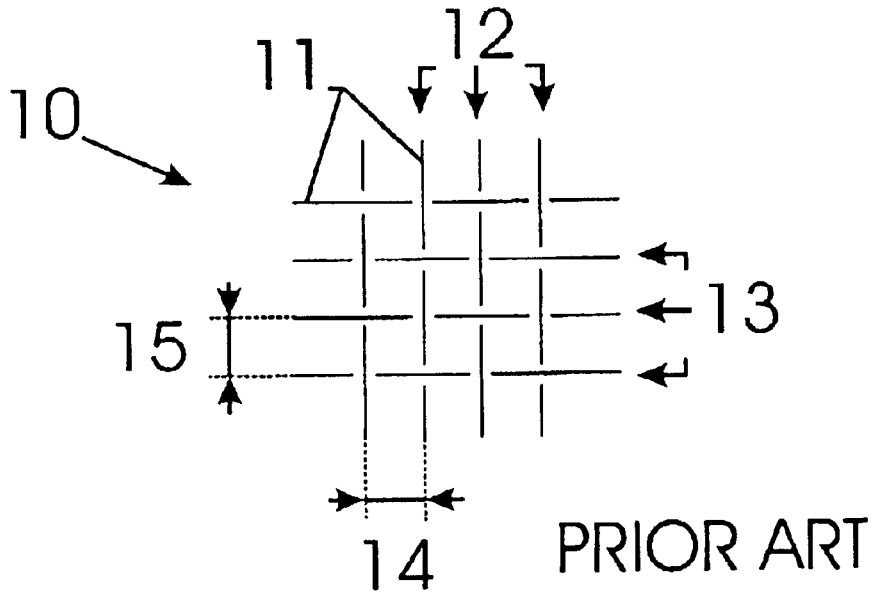
FIG. 1 shows a fabric, to be used to provide cut-resistance or reinforcement of protective textiles as known in the art.

FIG. 1 shows a fabric 10 to be used to provide reinforcement or cut-resistance to protective textile, comprising elongated steel elements as known in the art. Elongated Steel elements 11 are woven into a plain-woven structure, having warp elements 12 and weft elements 13. Each warp element and weft element comprises one elongated steel element 11, which has its own path through the fabric. Between adjacent warp elements a distance 14 is provided. Between adjacent weft elements a distance 15 is provided.

Figure 2:
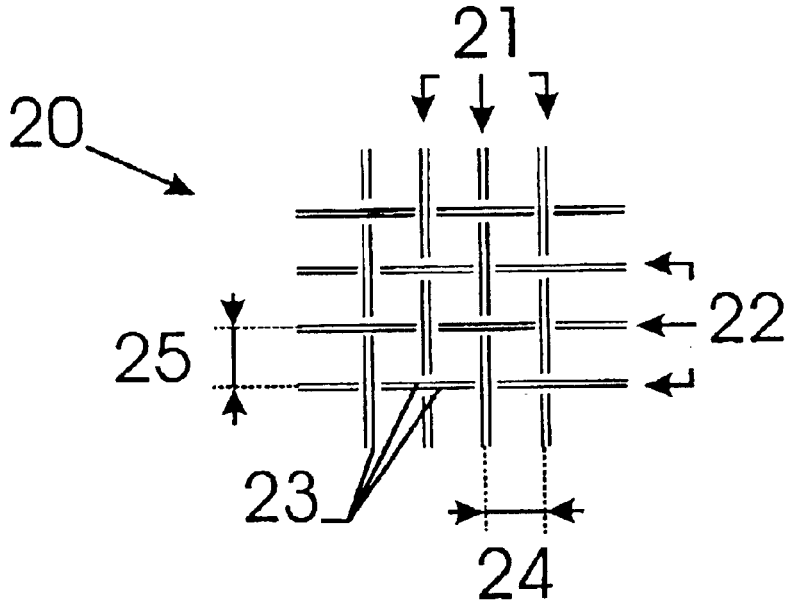
FIG. 2 shows a fabric, to be used to provide cut-resistance or reinforcement of protective textiles as subject of the invention.

A fabric as subject of the invention is shown in FIG. 2. A fabric as subject of the invention may be a plain-woven fabric 20, comprising warp elements 21 and weft elements 22. According to the invention, either warp elements 21 or weft elements 22, or both, comprise more than one elongated steel element 23, being in contact relationship with each other. In the present embodiment, a fabric as subject of the invention is shown, of which warp elements and weft elements comprise two elongated steel elements. Between adjacent warp elements a distance 24 is provided. Between adjacent weft elements a distance 25 is provided.

A clear and drastically improvement of the cut-resistance was noticed between a protective textile comprising a fabric 10 as known in the art, and a comparative protective textile comprising a fabric 20 as subject of the invention. A cut-resistance comparative test was executed as follows.

Four different protective textiles were provided by laminating two sheets of polyurethane to a fabric which is to provide cut-resistance to the protective textile, said protective textile being useful as a protective canvass. Each sheet of polyurethane has a thickness of 175 $\mu$m. Sample I and II are protective textiles, comprising a fabric as subject of the invention. These fabrics had a weaving structure as shown in FIG. 2. Sample III and IV are protective textiles, comprising a fabric as was known in the art. These fabrics had a weaving structure as shown in FIG. 1. More information on the samples I to IV is to be found in table A. It should be noticed that all samples comprise a same number of elongated steel elements per surface unit. Sample I and II, and sample II and IV comprise the same elongated steel elements. Sample I and III have the same steel covering ratio. Sample II and IV also have an identical steel covering ratio. For all samples, no difference for cut resistance was noticed in warp and weft direction.

Figure 3:
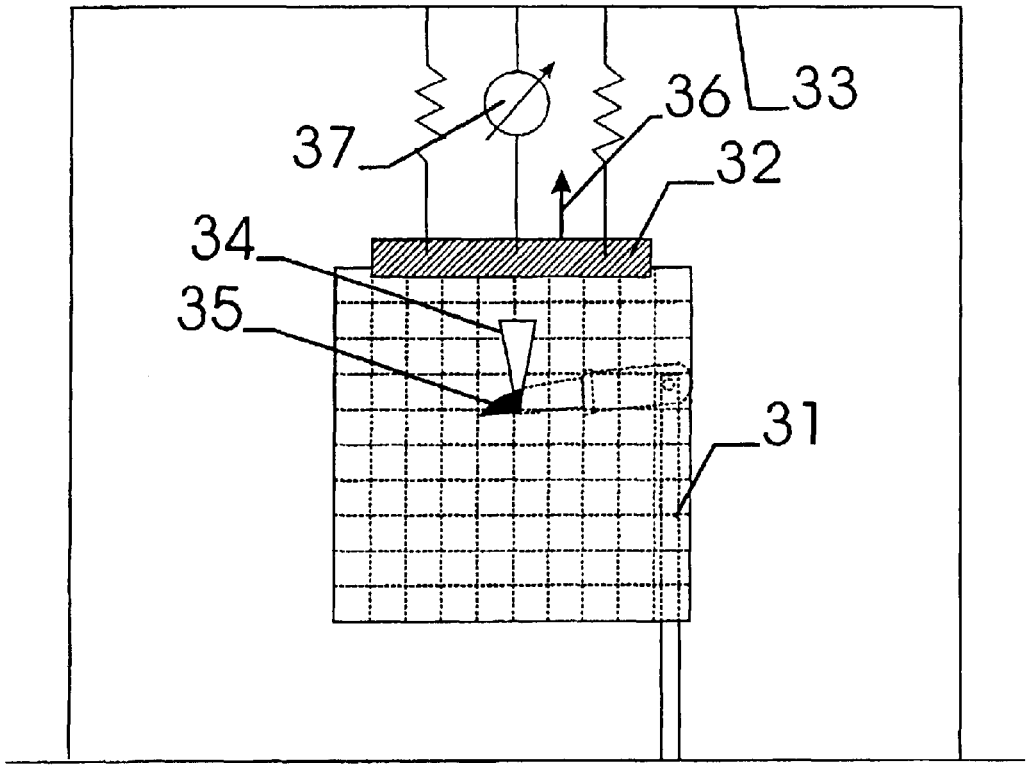
FIG. 3 shows a schematic view of a cut-resistance test device for protective textiles.

All four samples were subjected to a cut-resistance test. FIG. 3 provides a schematic view of the test set-up. A part of protective textile 31 is clamped with clips 32, in order to fix the protective textile vertically. The dimensions of the protective textile part are approximately 230 mm by 310 mm. The protective textile part is hung to a framework 33. A pre-cut 34 of approximately 50 mm is made. A knife 35 with a straight edge pointing downwards is inserted in the pre-cut and moved downwards (as indicated by arrow 36). The force necessary to move the knife downward over a distance of 250 mm through the protective textile is registered by a measuring system 37. Each time the knife meets an elongated steel element, the force to continue the movement downward increases until the elongated steel element is cut. A "saw-shaped" curve 'force-distance' is obtained which has several maxima, one maximum for each elongated steel element, which is cut. An average of these maxima is calculated. For each test, a new knife 35 is to be used.

For these samples, a force as shown in table B was measured as an indication for the cut-resistance. Forces were measured when cutting both warp elements and weft elements. Equal forces were measured during tests in warp and weft cutting direction, since both warp and weft were identical.

TABLE A

| | Invention Sample I | Invention Sample II | Reference Sample III | Reference Sample IV |
|---|---|---|---|---|
| Elongated Steel elements in warp and weft direction | Single strand steel cord 1 × 4 × 0, 25 | Multi-strand steel cord 3 × 3 × 0, 18 | Single strand steel cord 1 × 4 × 0, 25 | Multi-strand steel cord 3 × 3 × 0, 18 |
| Distance between warp elements (14 & 24) | 10 mm | 10 mm | 5 mm | 5 mm |
| Distance between weft elements (15 & 25) | 10 mm | 10 mm | 5 mm | 5 mm |
| Weaving structure | As in FIG. 2 | As in FIG. 2 | As in FIG. 1 | As in FIG. 1 |
| diameter elongated steel elements (dA = Db) | 0.613 mm | 0.752 mm | 0.613 mm | 0.752 mm |
| Steel covering ratio Cs | 23% | 27.8% | 23% | 27.8% |

TABLE B

| | daN |
|---|---|
| Sample I | 71.2 |
| Sample II | 70.3 |
| Sample III | 29.6 |
| Sample IV | 31.4 |

It is clear that when a fabric as subject of the invention is used, the cut-resistance is improved drastically. Even when the total content of elongated steel elements and the steel covering ratio in the protective textile was kept equal.

An alternative fabric as subject of the invention, and more preferably used for protective garment is a plain-woven fabric 20, as shown in FIG. 2, comprising warp elements 21 and weft elements 22 being steel cords with construction 12×0.18. for each warp element and weft element, two steel elements are in contact relationship with each other. Between adjacent warp elements a distance 24 of 4 mm is provided. Between adjacent weft elements a distance 25 of 4 mm is provided, providing a steel covering ratio of 70%.

In general, it was noticed that, when either a warp element or a weft element had to be cut, the cut-resistance could be improved by providing two or more elongated steel elements, being in contact relationship with each other.

Figure 4A:
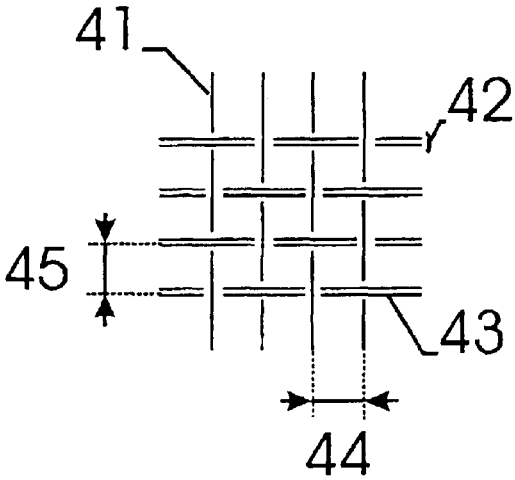
FIGS. 4 to 6 shows other fabrics, to be used to provide cut-resistance or reinforcement of protective textiles as subject of the invention.
Figure 4B:
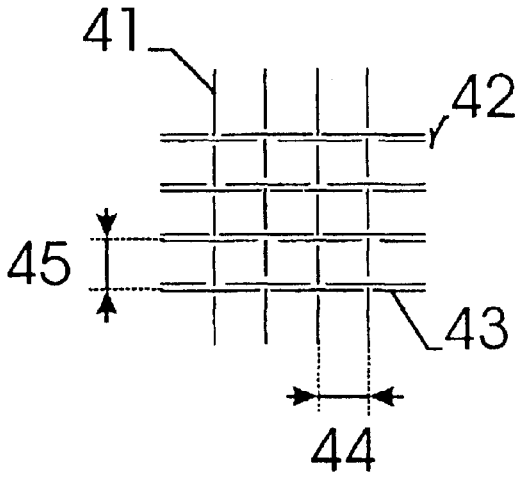
Figure 5:
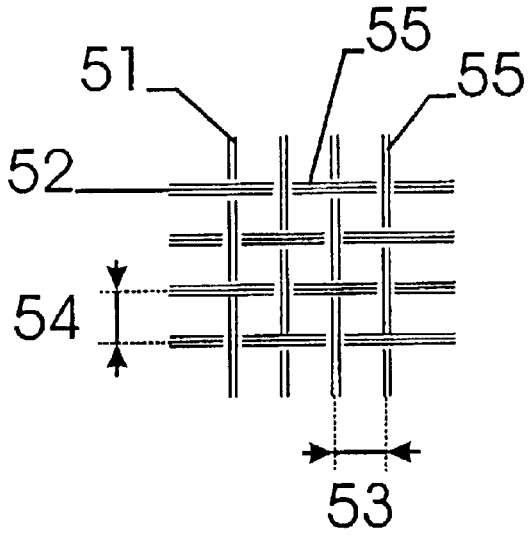
Figure 6:
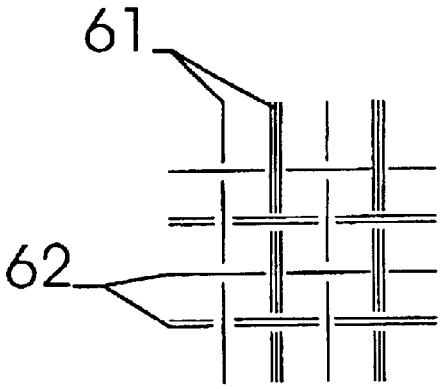

Other embodiments of a fabric as subject of the invention are shown in FIGS. 4 to 6.

As shown in FIGS. 4*a* and 4*b*, the cut-resistance may only be improved in one direction. FIG. 4*a* shows a plain-woven fabric, with warp elements 41 and weft elements 42. Each weft element 42, being on a distance 44 from each other, comprises two elongated steel elements 43. Each warp element, being on a distance 43 from each other, comprises one elongated steel element. All individual elements 43 of the weft element cross the warp elements identically.

In FIG. 4*b*, an alternative embodiment is shown, where the individual elements 43 of the weft elements cross the warp elements non identically. One understands that the individual elements of the warp and/or the weft elements may cross the individual elements of the weft respectively the warp element in many different ways, so providing different embodiments of a fabric according to the invention.

A preferred embodiment is provided when elongated steel elements of type 3×3×0.18 multi-strand steel cords are used to provide a fabric as shown in FIG. 4*a* or 4*b*, with distance 43 being 5 mm and distance 44 being 10 mm. A steel covering ration of 27.5% is obtained Alternatively, either all or some of the warp elongated steel elements 41 may be replaced by polymer yarns, such as polyamide-fiber yarns to provide an alternative embodiment of a fabric as subject of the invention. As shown in FIG. 5, the cut-resistance may be improved to a larger extend either in warp or weft direction. FIG. 5 shows a plain-woven fabric, comprising warp elements 51 and weft elements 52, warp elements and weft elements being on a distance of respectively 53 and 54. Warp elements may comprise a different number of elongated steel elements 55 than weft elements.

As shown in FIG. 6, each warp element does not have to comprise the same number of elongated steel elements. Neither each warp element does have to comprise the same number of elongated steel elements. As shown in the embodiment of FIG. 6, warp elements 61 and weft elements 62 may comprise different number of elongated steel elements.

Figure 7:
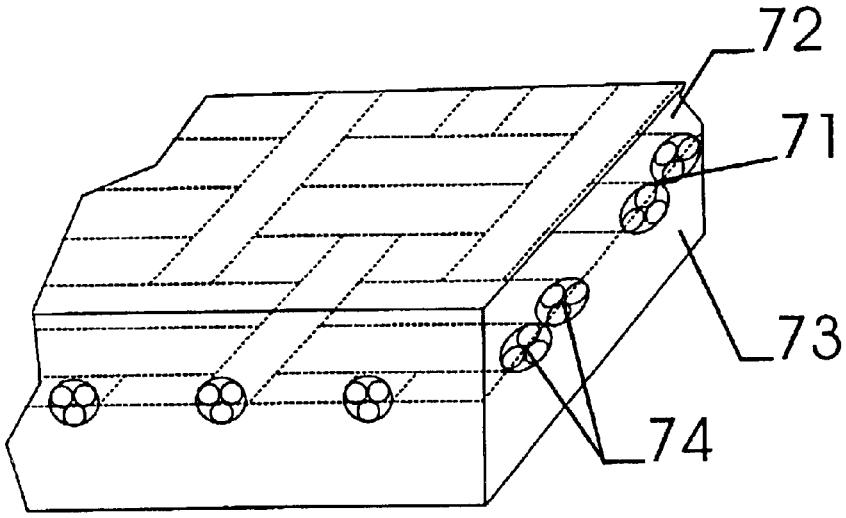
FIG. 7 shows a canvas as subject of the invention.

The fabrics as subject of the invention may be used to provide cut-resistance or reinforcement for protective textiles. As shown in FIG. 7, a fabric 71 as subject of the invention may be used to provide canvasses. The fabric 71 is laminated between two layers of polymer 72 and 73, e.g. Polyurethane with thickness of 0.5 mm each. In the embodiment as shown in FIG. 7, only the warp or the weft elements comprise two elongated steel elements 74 according to the invention.

What is claimed is:

1. A fabric comprising a warp and a weft, said warp comprising warp elements, said weft comprising weft elements, wherein said fabric has a steel covering ratio of less than 60%, wherein at least one of said warp elements or at least one of said weft elements or both comprise two or more elongated steel elements being in contact relationship with each other.

2. A fabric as in claim 1, wherein at least one of said warp elements and at least one of said weft elements comprise elongated steel elements.

3. A fabric as in claim 2, wherein at least one of said warp elements and at least one of said weft elements comprise two or more elongated steel elements being in contact relationship with each other.

4. A fabric as in claim 2, wherein the number of elongated steel elements of said warp element is different from the number of elongated steel elements of said weft element.

5. A fabric as in claim 2, wherein the number of elongated steel elements of said warp element is identical to the number of elongated steel elements of said weft element.

6. A fabric as in claim 2, wherein different warp elements comprise a different number of elongated steel elements.

7. A fabric as in claim 2, wherein different weft elements comprise a different number of elongated steel elements.

8. A fabric as in claim 1, wherein the distance between adjacent warp elements is different from the distance between adjacent weft elements.

9. A fabric as in claim 1, wherein the distance between adjacent warp elements is identical to the distance between adjacent weft elements.

10. A fabric as in claim 1, wherein said elongated steel elements are steel cords.

11. A fabric as in claim 10, said steel cord having a construction 3×3×0.18.

12. A fabric as in claim 10, said steel cord having a construction 4×7×0.1.

13. A fabric as in claim 10, said steel cord having a construction 1×4×0.25.

14. A fabric as in claim 10, said steel cord having a construction 12×0.18.

15. A fabric as in claim 1, said fabric further comprising synthetic or natural fibers.

16. The use of a fabric as in claim 1, to provide cut-resistance to a protective textile.

17. The use of a fabric as in claim 1, to provide cut-resistance to a protective clothing.

18. The use of a fabric as in claim 1, to provide cut-resistance to a protective canvas.

19. A protective textile comprising a fabric as in claim 1.

20. A protective textile as in claim 19, said protective textile comprising at least one polymer layer, said polymer layer adhering to said fabric.

21. A protective textile as in claim 20, said polymer layer comprising polymer material selected from the group consisting of silicon-based polymers, polyurethane, polyamide, polyvinylchloride, synthetic or natural rubbers, polyesters or polytetrafluorethylene.

22. A fabric comprising a warp and a weft, said warp comprising warp elements, said weft comprising weft elements, wherein at least one of said warp elements or at least one of said weft elements or both comprise two or more elongated steel elements being in contact relationship with each other, and wherein said fabric has a steel covering ratio is less than 40%.

23. A fabric comprising a warp and a weft, said warp comprising warp elements, said weft comprising weft elements;

wherein at least one of i) said warp elements comprises a plurality of warps in substantial contact relationship with each other or ii) said weft elements comprise a plurality wefts in substantial contact relationship with each other or iii) said warp elements and at least one of said weft elements comprise a plurality of warps and wefts, respectively, in substantial contact relationship with each other, respectively;

wherein (n) type(s) of elongated steel elements are present in a warp direction and (m) type(s) of elongated steel elements are present in a weft direction;

and wherein said fabric has a steel covering ratio (Cs) of less than 60% as determined by the following equation:

$$Cs=[B^*(\Sigma_n\alpha_n{}^*Da_n)+A^*(\Sigma_m\beta_m{}^*Db_m)-(\Sigma_n\alpha_n{}^*Da_n)^*(\Sigma_m\beta_m{}^*Db_m)]^*100/A^*B,$$

where:

A =length of the fabric in warp direction,

B =length of the fabric in welt direction, $\alpha$=Number of elongated steel elements present in the warp direction, $\beta$=Number of elongated steel elements present in the weft direct, Da=diameter of the elongated steel element in warp direction A, Db =diameter of the elongated steel element in welt direction B, $$\Sigma_n\alpha_n{}^*Da_n=\alpha_1{}^*Da_1+\alpha_2{}^*Da_2+\ldots+\alpha_n{}^*Da_n, \text{ and}$$

$$\Sigma_m\beta_m Db_m=\beta_1{}^*Db_1+\beta_2{}^*Db_2+\ldots+\beta_m Db_m.$$

24. A fabric according to claim 23, wherein said fabric has a steel covering ratio (Cs) of less than 40%.

* * * * *